US010032412B2

(12) United States Patent
Zhu et al.

(10) Patent No.: US 10,032,412 B2
(45) Date of Patent: Jul. 24, 2018

(54) ORGANIC LIGHT EMITTING DIODE PIXEL DRIVING CIRCUIT, DISPLAY PANEL AND DISPLAY DEVICE

(71) Applicants: Shanghai Tianma AM-OLED Co., Ltd., Shanghai (CN); Tianma Micro-Electronics Co., Ltd., Shenzhen (CN)

(72) Inventors: Minyu Zhu, Shanghai (CN); Dong Qian, Shanghai (CN)

(73) Assignees: Shanghai Tianma AM-OLED Co., Ltd., Shanghai (CN); Tianma Micro-Electronics Co., Ltd., Shenzhen (CN)

( * ) Notice: Subject to any disclaimer, the term of this patent is extended or adjusted under 35 U.S.C. 154(b) by 22 days.

(21) Appl. No.: 15/159,766

(22) Filed: May 19, 2016

(65) Prior Publication Data

US 2017/0103701 A1 Apr. 13, 2017

(30) Foreign Application Priority Data

Oct. 13, 2015 (CN) ..... 2015 1 0669554

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01);
(Continued)

(58) Field of Classification Search
CPC ..... G09G 3/3233; G09G 2300/0819; G09G 2300/0842; G09G 2300/0861; G09G 2320/045; G09G 2320/0233
See application file for complete search history.

(56) References Cited

U.S. PATENT DOCUMENTS

2008/0211397 A1* 9/2008 Choi ..... G09G 3/3233 313/504
2013/0069852 A1* 3/2013 Liao ..... G09G 3/3233 345/77
2016/0284273 A1* 9/2016 Ma ..... G09G 3/3258

FOREIGN PATENT DOCUMENTS

CN 103000126 A 3/2013
CN 104143313 A 11/2014
(Continued)

*Primary Examiner* — Amr Awad
*Assistant Examiner* — Wing Chow
(74) *Attorney, Agent, or Firm* — Kilpatrick Townsend & Stockton LLP

(57) ABSTRACT

An organic light emitting diode pixel driving circuit includes a pixel capacitor for storing a received voltage and coupling a change valve of the voltage at a first electrode thereof to a second electrode thereof; a first transistor for providing a reference voltage to the first electrode of the pixel capacitor under the control of a first light emitting signal; a third transistor for transmitting a data voltage to second electrode of the pixel capacitor under the control of the first scanning signal; and a fourth transistor; thereby overcoming the uneven display of the entire image, which is caused by the drift of the threshold voltage of the driving transistor and the different driving current driving the different OLEDs to emit light when the different OLEDs receive the same image data signal, the different driving current is caused by the difference the high-level power supply voltages.

19 Claims, 3 Drawing Sheets

(52) U.S. Cl.
CPC ..... *G09G 2300/0861* (2013.01); *G09G 2320/0233* (2013.01); *G09G 2320/045* (2013.01)

(56) References Cited

FOREIGN PATENT DOCUMENTS

| | | | |
|---|---|---|---|
| CN | 104157240 | A | 11/2014 |
| CN | 104409042 | A | 3/2015 |

* cited by examiner

ORGANIC LIGHT EMITTING DIODE PIXEL DRIVING CIRCUIT, DISPLAY PANEL AND DISPLAY DEVICE

CROSS-REFERENCES TO RELATED APPLICATION

The present application claims priority of Chinese patent application No. 201510669554.5 filed on Oct. 13, 2015 and entitled "Organic Light Emitting Diode Pixel Driving Circuit, Display Panel and Display Device", the content of which is incorporated herein by reference in its entirety.

TECHNICAL FIELD

The present disclosure relates to the field of display technologies, in particular to an organic light emitting diode pixel driving circuit, a display panel and a display device.

BACKGROUND

An organic light emitting diode display module (AMOLED) is one of the hotspots within the field of flat panel display device researches. Compared to a liquid crystal display module, the organic light emitting diode display module has advantages such as low power consumption, a low production cost, self-luminous and wide viewing angle and fast response. At present, the organic light emitting diode display module has begun to replace conventional liquid crystal display module in the display area such as mobile phones, tablets and digital camera. Pixel driving circuit design is the core technology of the organic light emitting diode display module and has important research significance.

The organic light emitting diode display module can be classified into two types based on driving mode: a passive matrix organic light emitting diode (PMOLED) display module and an active matrix organic light emitting diode (AMOLED) display module, namely a direct addressing and a thin film transistor (TFT) matrix addressing. The active matrix organic light emitting diode display module, which has pixels arranged in an array form and high luminous efficacy, is of an active display type and commonly used as large-size high-definition display device. Unlike the liquid crystal display module using stable voltage to control brightness, the active matrix organic light emitting diode display module is driven by the current and need the stable current to control the light emitting thereof. Due to process technology and modular member deterioration and other reasons, the threshold voltage (Vth) of driving transistors of each pixel drifts, so that the current flowing through each pixel varies as the threshold voltage, thereby leading to the uneven display luminance. Meanwhile, IR-drop, caused by resistance of power supply lines connecting various pixels on the panel and the electric charges consumed by various pixels when emitting light, can also arouse the display unevenness, so that the pixels in proximity to the display pixel drive module are brighter while those away from the display pixel drive module are darker (that is, the pixels are getting dark with the distant from the display pixel drive module), thereby affecting the display effect of the entire image. Therefore, there is a need for the pixel driving circuit being capable of compensating the threshold voltage drift of the driving transistor and IR-drop of the supply power.

SUMMARY

In view of this, for solving the uneven display of the organic light emitting diode display device in the prior art due to the process technology, the modular member deterioration and IR-drop and other reason, embodiments of the present disclosure are to provide a pixel driving circuit being capable of compensating the threshold voltage drift of the drive thin film transistor and IR-drop of the supply power.

For this, the present disclosure is to provide an organic light emitting diode pixel driving circuit including:

a pixel capacitor including a first electrode and a second electrode, which is configured for storing received voltage and coupling a change valve of a voltage at the first electrode to the second electrode; a driving transistor, for generating a driving current based on a power supply voltage and the voltage at the second electrode of the pixel capacitor;

a first transistor, for providing a reference voltage to the first electrode of the pixel capacitor under the control of a first light emitting signal;

a second transistor, for transmitting a high-level power supply voltage to the first electrode of the pixel capacitor under the control of a second light emitting signal;

a third transistor and a fourth transistor, both for transmitting a difference between a data voltage and a threshold voltage of the driving transistor to the second electrode of the pixel capacitor under the control of a first scanning signal; and an organic light emitting diode, which emits light under the control of the driving current generated by the driving transistor.

The present disclosure is further to provide a display panel, including the organic light emitting diode pixel driving circuit described above.

The present disclosure is further to provide a display device, including the organic light emitting diode pixel driving circuit described above.

Compared to the prior art, the organic light emitting diode pixel driving circuit, the display panel and the display device provided by the present disclosure are capable of compensating the effects of the threshold voltage drift of the drive thin film transistor and IR-drop of the supply power on the image display, solving the uneven display of the organic light emitting diode display device in the prior art due to the process technology, the modular member deterioration and IR-drop and other reason.

DESCRIPTION OF DRAWINGS

The accompanying drawings are included to provide a further understanding of the present disclosure, which are incorporated in and constitute a part of the disclosure. The accompanying drawings illustrate embodiments of the disclosure, and are used for explaining the principles of the disclosure in conjunction with the description.

DETAILED DESCRIPTION OF THE EMBODIMENT

Embodiments of the present disclosure are below described in detail according to the accompanying drawings. Further, the present disclosure is not limited to the following embodiments.

Figure 1:
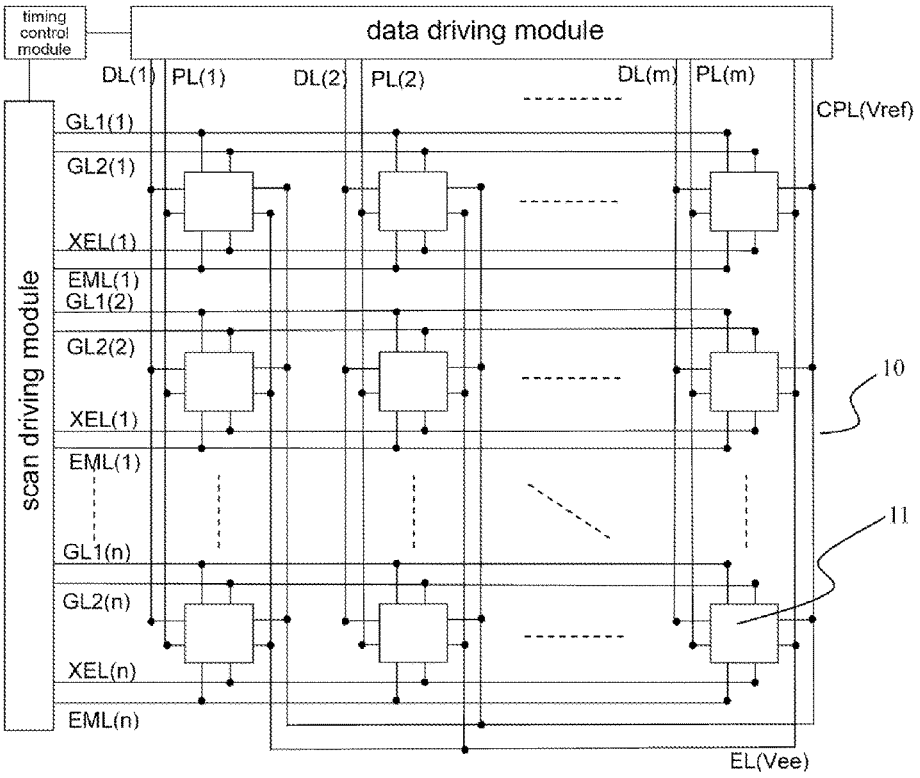
FIG. 1 schematically shows the composition of an organic light emitting diode display panel of an embodiment of the present disclosure.

As shown FIG. 1, an organic light emitting diode display panel according to an embodiment of the present disclosure includes an array substrate 10, a timing control module, a scan driving module and a data driving module.

The array substrate 10 includes a plurality of pixel units 11 arranged in a matrix, the pixel units 11 emit light based on the corresponding scanning signals provided by a plurality of scanning lines GL1 (1) to GL1 (n) and GL2 (1) to the GL2 (n) from the scan driving module and the corresponding data voltage provided by a plurality of data lines DL(1) to DL(m) from the data driving module. To this end, an organic light emitting diode pixel driving circuit within one pixel unit 11 includes an organic light emitting diode OLED and a plurality of transistors and a capacitor module for driving the organic light emitting diode OLED to emit light. The specific configuration of each pixel unit 11 will be described below with reference to FIG. 2.

The timing control module receives a vertical synchronizing signal Vsync from the outside, a horizontal synchronization signal Hsync, a data enable signal DE, a clock signal CLK and a video signal (not shown). Further, the timing control module arranges the video signal externally inputted into digital image data in units of frames. For example, the timing control module controls the operation timing of each of the scan driving module and the data driving module using the timing signals including the vertical synchronizing signal Vsync, the horizontal synchronization signal Hsync, the data enable signal DE and the clock signal CLK. To this end, the timing control module generates a strobe control signal GCS for controlling the operation timing of the scan driving module, and a data control signal DCS for controlling the operation timing of the data driving module.

The scan driving module generates a first scanning signalScan1, a second scanning signalScan2, a first light emitting signal XE and a second light emitting signal EMIT, such that the transistor in each pixel unit 11 included in the array substrate 10 can be operated based on the strobe control signal GCS provided by the timing control module, and the first scanning signalScan1 and the second scanning signal Scan 2 are supplied to the array substrate 10 by the scanning lines GL1, GL2, the first and second light emitting signals XE and EMIT are supplied to the array substrate 10 by a first light emitting signal transmission line XEL (n) and a second light emitting signal transmission line EML (n).

The data driving module generates a data signal using the digital image data and the data control signals DCS provided by the timing control module, and provides the generated data voltage Vdata to the array substrate 10 by the corresponding data line DL.

In an implementation, the data driving module further includes a power module for generating a high-level power supply voltage Vdd, a low-level power supply voltage Vee and a reference voltage Vref. The high-level power supply voltage Vdd is supplied to the array substrate 10 via a high-level power supply voltage transmission line PL (m), the low-level power supply voltage Vee is supplied to the cathode of the organic light emitting diode OLED on the array substrate 10 via a low-level power supply voltage transmission line EL, the reference voltage Vref is supplied to the array substrate 10 via a reference voltage transmission line CPL (ref).

The specific configuration of the organic light emitting diode pixel driving circuit within each pixel will be below described with reference to FIGS. 1 and 2.

Figure 2:
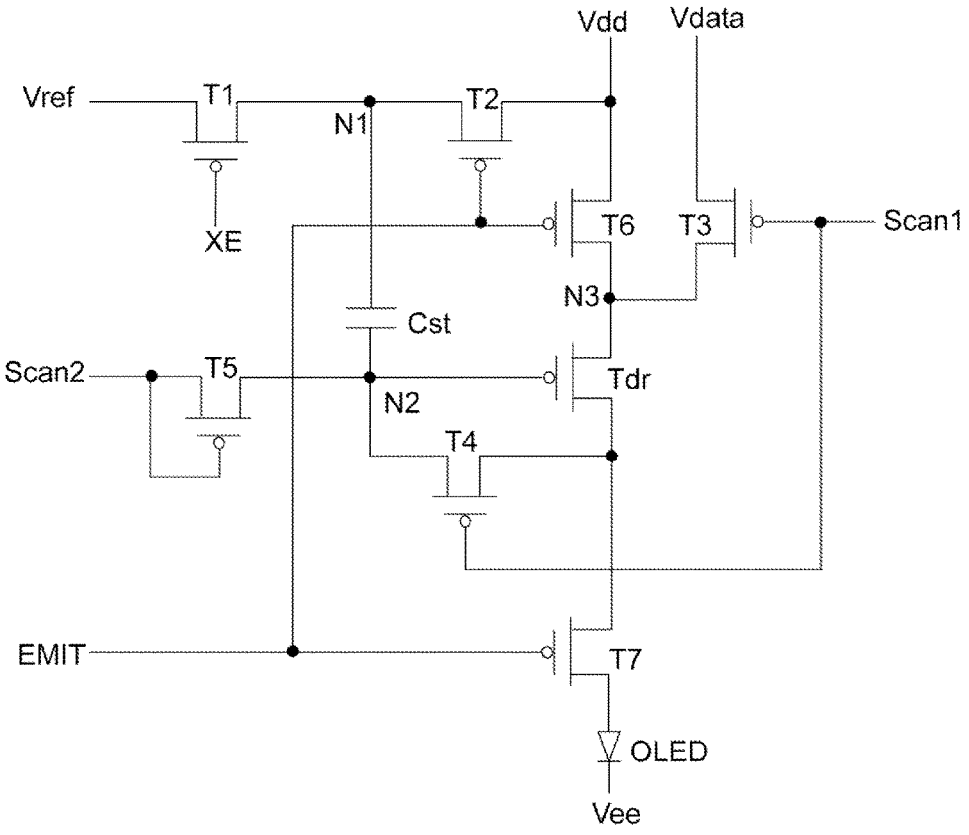
FIG. 2 is an equivalent circuit diagram schematically showing an organic light emitting diode pixel driving circuit within each pixel unit in FIG. 1.

FIG. 2 is an equivalent circuit diagram schematically showing an organic light emitting diode pixel driving circuit within each pixel unit in FIG. 1. As shown in FIG. 2, the organic light emitting diode pixel driving circuit within each pixel unit 11 may include a first transistor T1, a second transistor T2, a third transistor T3, a fourth transistor T4, a fifth transistor T5, a sixth transistor T6, a seventh transistor T7, a driving transistor Tdr, a pixel capacitor Cst, and an organic light emitting diode OLED.

Each of the first transistor T1 to the seventh transistor T7 and the driving transistor Tdr as shown in FIG. 2 is a PMOS transistor, but are not limited thereto. As another embodiment, NMOS transistors may be applied to said transistors. For example, one or more of the first transistor T1 to the seventh transistor T7 and the driving transistor Tdr are an NMOS transistor. In this case, the voltage for turning on the NMOS transistor has the opposite polarity to the voltage for turning on the PMOS transistor.

In an implementation, a first electrode of the first transistor T1 receives a reference voltage Vref, a second electrode of the first transistor is connected to a first electrode of a pixel capacitor Cst, i.e., a first node N1, and a gate electrode of the first transistor T1 receives a first light emitting signal XE, for transmitting the reference voltage to the first electrode of the pixel capacitor Cst (i.e., the first node N1) under the control of the first light emitting signal XE.

A first electrode of the second transistor T2 receives a high-level power supply voltage Vdd, a second electrode of the second transistor T2 is connected to the first electrode of the pixel capacitor Cst, i.e., the first node N1, and a gate electrode of the second transistor T2 receives a second light emitting signal EMIT, for transmitting the high-level power supply voltage Vdd to the first electrode of the pixel capacitor Cst (i.e., the first node N1) under the control of the second light emitting signal XE.

A first electrode of the third transistor T3 receives a data voltage Vdata, a second electrode of the third transistor T3 is connected to a first electrode of the driving transistor Tdr and a second electrode of the sixth transistor T6, and a gate electrode of the third transistor T3 receives the first scanning signal Scan1, for transmitting the data voltage Vdata to first electrode of the driving transistor Tdr (i.e., a third node N3) under the control of the first scanning signal Scan 1.

A second electrode of the fourth transistor T4 is connected to the gate electrode of the driving transistor Tdr, a first electrode of the fourth transistor T4 is connected to a second electrode of the driving transistor Tdr, a gate electrode of the fourth transistor T4 receives the first scanning signal Scan1, for connecting the second electrode of the driving transistor Tdr to the gate electrode of the driving transistor Tdr under the control the first scanning signal Scan1, reading the difference between the data voltage Vdata and a threshold voltage |Vth| of the driving transistor Tdr, and transmitting it to a second electrode of the pixel capacitor Cst, i.e., a second node N2.

A first electrode and a gate electrode of the fifth transistor T5 receives a second scanning signal Scan2 simultaneously, and a second electrode of the fifth transistor T5 is connected to the second electrode of the pixel capacitor Cst, for resetting the voltage at the gate electrode of the driving transistor Tdr under the control of the second scanning signal Scan2.

A first electrode of the sixth transistor T6 receives the high-level supply voltage Vdd, the second electrode of the sixth transistor T6 is connected to the first electrode of the driving transistor Tdr, and a gate electrode of the sixth transistor T6 receives the second light emitting signal EMIT, for transmitting the high-level power supply voltage Vdd received by the sixth transistor T6 to the first electrode of the driving transistor Tdr under the control of the second light emitting signal EMIT.

A first electrode of the seventh transistor T7 is connected to the second electrode of the driving transistor Tdr, a second electrode of the seventh transistor T7 is connected to an anode of the organic light emitting diode OLED, a gate electrode of the seventh transistor T7 receives the second light emitting signal EMIT, for transmitting a driving current I generated by the driving transistor Tdr to the organic light emitting diode OLED under the control of the second light emitting signal EMIT.

The anode of the organic light emitting diode OLED receives the driving current I generated by the driving transistor Tdr under the control of the seventh transistor T7, a cathode of the organic light emitting diode OLED receives a low-level signal Vee and emits light with the action of the drive current I.

In the implementation, each of the first transistor T1 to the seventh transistor T7 and the driving transistor Tdr is the PMOS transistor, the first and second scanning signals Scan1 and Scan2 are the low-level signal, and the reference voltage Vref is the ideal high-level power voltage Vdd.

Figure 3:
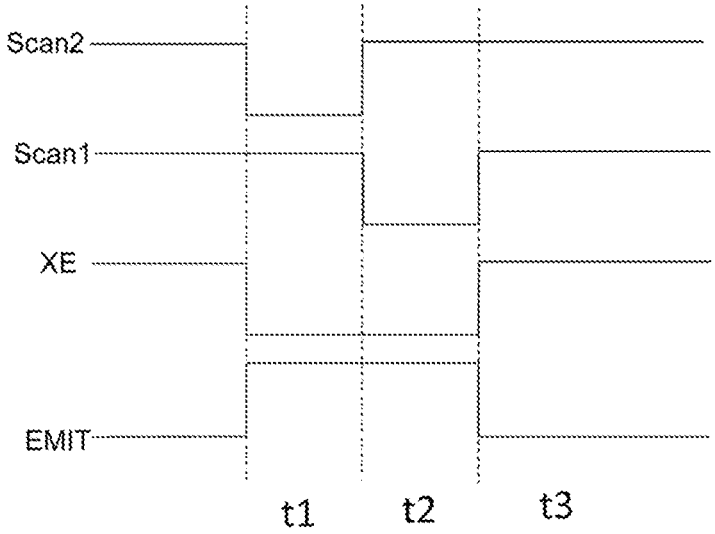
FIG. 3 is a sequence diagram providing the equivalent circuit as shown in FIG. 2 with a control signal.

FIG. 3 is a sequence diagram of the driving circuit within each pixel unit in the first embodiment and shows a specific working principle. See also FIGS. 2 and 3. The working process of the driving circuit within each pixel unit is divided into gate electrode reset stage of the driving transistor Tdr, the threshold voltage compensation stage of the driving transistor Tdr, the light emitting stage of the organic light emitting diode OLED.

The first stage is a gate electrode reset stage of the driving transistor Tdr. At this point, the first light emitting signal XE and the second scanning signalScan2 are low-level signals, the first scanning signalScan1 and the second light emitting signal EMIT are high-level signals, the first transistor T1 and the fifth transistor T5 are turned on, and the second transistor T2, the third transistor T3, the fourth transistor T4, the sixth transistor T6 and the seventh transistor T7 are cut off.

The first transistor T1 is turned on, the reference voltage Vref received by the first transistor T1 is transmitted to the first electrode of the pixel capacitor Cst, i.e., the first node N. In the implementation, the potential of the reference voltage Vref is set as the ideal high-level power supply voltage Vdd, i.e., the high-level power supply voltage Vdd without any current consumption. The high-level power supply voltage Vdd actually inputted to the driving circuit of the various pixel units 11 are different from each other due to the resistance in the high-level power supply transmission lines PL (m), that is, the high-level power supply voltage Vdd actually inputted to the driving circuit of the various pixel units 11 have a certain voltage drop with respect to the ideal high-level power supply voltage Vdd.

Assuming that the voltage drop is ΔVdd when the high-level power supply Vdd reaches the driving circuit of the pixel unit as shown in FIG. 2, namely: ΔVdd=Vref−Vdd, where Vdd is a practical high-level power supply voltage after generating the voltage drop. Since the reference voltage Vref has no current consumption on the reference voltage transmission line CPL, the voltage valve thereof may always be maintained to be Vref such that the first electrode of the pixel capacitor Cst (i.e., the first node N1) is maintained to be the ideal voltage: Vref=(Vdd+ΔVdd).

Meanwhile, the second scanning signal Scan 2 is the low-level signal, the fifth transistor T5 is turned on, and the second electrode of the pixel capacitor Cst (i.e., the second node N2) receives the second scanning signal Scan2 to reduce the voltage at the second node N2 by receiving the low-level second scanning signal Scan2, thus resetting the potential at the gate electrode of the driving transistor Tdr.

The second stage is a threshold voltage compensation stage of the driving transistor Tdr. At this point, the first scanning signal Scant and the first light emitting signal XE are the low-level signals, the second scanning signal Scan 2 and the second light emitting signal EMIT are the high-level signals, and the first transistor T1 is maintained to be in the on-state, the third transistor T3 and the fourth transistor T4 are turned on while the second transistor T2, the fifth transistor T5 to seventh transistor T7 is maintained to be in the off-state.

Since the first transistor T1 remains to be in the on-state, no matter how the voltage at the second electrode of the pixel capacitor Cst (i.e., the second node N2) changes, the voltage at the first electrode of the pixel capacitor Cst (i.e., the first node N1) does not change accordingly, and is maintained to be the reference voltage Vref, and Vref=(Vdd+ΔVdd).

Since the third transistor T3 is turned on while the sixth transistor T6 is cut off, the first electrode of the driving transistor Tdr receives the data voltage Vdata, such that the voltage at the first electrode of the driving transistor Tdr, that is, Vs=Vdata. Since the fourth transistor T4 is turned on, the driving transistor Tdr is deemed to be equivalent to a diode connection structure, that is, the gate electrode of the driving transistor Tdr is connected with the second electrode of the driving transistor Tdr. The fourth transistor T4 reads the difference between the data voltage Vdata and the threshold voltage |Vth| of the driving transistor Tdr, and transmits the same to the second electrode of the pixel capacitor Cst, i.e., the second node N2 or the gate electrode of the driving transistor Tdr. Accordingly, when the voltage Vs at the first electrode of the driving transistor Tdr is Vdata, the voltage Vg at the gate electrode of the driving transistor Tdr is (Vdata−|Vth|). Likewise, the voltage at the second electrode of the driving transistor Tdr is (Vdata−|Vth|), where, |Vth| of the driving transistor Tdr threshold voltage.

Thus, the voltage at the second electrode of the pixel capacitor Cst (i.e. the second node N2) is (Vdata−|Vth|).

Further, the voltage difference between the first electrode of the pixel capacitor Cst and the second electrode of the pixel capacitor Cst is: (Vdd+ΔVdd)−(Vdata−|Vth|).

The third stage t3 is the light emitting stage of the organic light emitting diode OLED. At this point, the first scanning signal Scant, the second scanning signal Scan2 and the first light emitting signal XE are the high-level signal, the second light emitting signal is low-level signal EMIT, the first transistor T1, the third transistor T3, the fourth transistor T4 and the fifth transistor T5 are cut off, and the second transistor T2, the sixth transistor T6 and the seventh transistor T7 are turned on.

Since the second transistor T2 is turned on while the first transistor T1 is cut off, the first electrode of the pixel capacitor Cst which receives originally the reference voltage Vref is turned into receive the high-level power supply voltage Vdd, such that the voltage at the first electrode of the pixel capacitor Cst (i.e. the first node N1) is changed from the reference voltage Vref (the ideal high-level power supply voltage) to the actual high-level power supply voltage Vdd, while the voltage difference between the reference voltage Vref and the actual high-level power supply voltage Vdd, i.e., the voltage drop ΔVdd of the high-level power supply voltage Vdd resulted from the resistance in the high-level power supply line PL is coupled to the second electrode of the pixel capacitor Cst through the first electrode of the pixel capacitor Cst, and is applied to the gate electrode of the driving transistor Tdr.

Since the voltage at the second electrode of the pixel capacitor Cst is the voltage at the gate electrode of the driving transistor Tdr, the voltage at the gate electrode of the driving transistor Tdr is now taken as Vg, the voltage at the first electrode of the pixel electrode capacitor Cst is the actual high-level power supply voltage Vdd, and the voltage at the second electrode of the pixel capacitor Cst is the voltage at the gate electrode of the driving transistor Tdr Vg.

According to the principle of the capacitor, after entering the third stage t3 from the second stage t2, the voltage difference between the first electrode and the second pixel of the pixel capacitor Cst will remain unchanged. As described above, at the second stage, the voltage at the first electrode of the pixel capacitor Cst is (Vdd+ΔVdd), and the voltage at the second electrode of the pixel capacitor Cst is (Vdata−|Vth|); at the third stage, the voltage at the first electrode of the pixel capacitor Cst is the actual high-level power supply voltage Vdd, and the voltage at the second electrode of the pixel capacitor Cst equals to the voltage at the gate electrode of the driving transistor Tdr.

Therefore, (Vdd+ΔVdd)−(Vdata−|Vth|)=Vdd−Vg.

Accordingly, Vg=Vdd−(Vdd+ΔVdd)+(Vdata−|Vth|)=−ΔVdd+(Vdata−|Vth|). That is, the voltage Vg at the gate electrode of the driving transistor is "−ΔVdd+(Vdata−|Vth|)."

Since the second light emitting signal EMIT is low level, the second scanning signal Scan2 is high level, the sixth transistor T6 is turned on and the third transistor T3 is cut off, such that the voltage Vs at the first electrode of the driving transistor Tdr is turned into Vdd from Vdata, that is, Vs=Vdd; in this case, the gate voltage difference Vsg between the voltage Vs at the first electrode of the driving transistor Tdr and the voltage Vg at the gate electrode of the driving transistor Tdr is: Vsg=Vs−Vg=Vdd+ΔVdd−(Vdata−|Vth|).

Therefore, it can be seen from the current characteristic equation of the transistor operation in the saturation region that the driving current outputted by the driving transistor Tdr is: I=K (Vsg−|Vth|)^2=K (Vdd+ΔVdd−Vdata)^2=K (Vref−Vdata)^2

Since the second light emitting signal EMIT is low level and the seventh transistor T7 is turned on, the driving current I outputted by the driving transistor Tdr is capable of driving the organic light emitting diode OLED to emit light. Where, Vg is the voltage at the gate electrode of the driving transistor Tdr, and Vs is the voltage at the first electrode of the driving transistor Tdr.

It can be seen from the above equation of the driving current that the driving current I outputted by the driving transistor Tdr is irrelevant to the threshold voltage of the driving transistor Tdr and the high-level power supply voltage Vdd driving the organic light emitting diode OLED to emit light, thereby overcoming the uneven display of the entire image which is caused by the drift of the threshold voltage |Vth| of the driving transistor Tdr and the different driving current driving the different OLEDs to emit light when the different OLEDs receive the same image data signal, the different driving current is caused by the difference of the high-level power supply voltages Vdd actually received between the driving circuit of the various pixel units resulted from the resistance in the high-level power supply transmission lines PL (m).

In addition, the driving transistor Tdr may adjust the current amount flowing through the organic light emitting diode OLED based on the voltage provided by the data voltage Vdata to the second node N2 connected to the gate electrode of the driving transistor. For example, the organic light emitting diode OLED emits light, and when the voltage, which is the threshold voltage |Vth| of the driving transistor higher than the data signal Vdata, is supplied to the second node N2, the current amount flowing through the organic light emitting diode OLED is proportional to the level of the data voltage Vdata. Therefore, the OLED display device according to the implementation of the present invention may provide the data voltages with the different levels to sub-pixels SP, respectively, to display different gray levels, thereby displaying the image.

The organic light emitting diode pixel driving circuit according to the implementation of the present invention may compensate the changes of the current flowing through the organic light emitting diode OLED resulted from the deviation of the threshold voltage |Vth| of the driving transistor Tdr and the voltage drop of the high-level power supply voltage Vdd. Moreover, based on the reference voltage Vref and the data voltage Vdata, the driving current of the driving transistor Tdr for driving the organic light emitting diode OLED to emit light is irrelevant to the deviation of the threshold voltage |Vth| and the voltage drop of the high-level power supply voltage Vdd, thereby maintaining the driving current to be a good constant current, further solving the drift of the threshold voltage |Vth| of the driving transistor Tdr and the uneven display of the entire image, which is caused by the different driving current driving the different OLEDs when the different OLEDs receive the same image data signal, the different OLEDs are caused by the difference the high-level power supply voltages Vdd actually received between the driving circuit of the various pixel units resulted from the resistance in the high-level power supply transmission lines PL (m).

The first electrode of the transistors (the first transistor to the seventh transistor and the driver transistor) mentioned in the embodiment of the present disclosure may be a source electrode (or a drain electrode) of the transistor, and the second electrode of the transistor may be the drain electrode of the transistor (or the source electrode, which may be determined depending on the type of the transistor). If the source electrode of the transistor is the first electrode, the drain electrode of the second transistor is the second electrode; if the drain electrode of the transistor is the first electrode, the source electrode of the transistor is the second electrode. Refer to the foregoing with respect to the specific operation mode, it is not described herein.

In the organic light emitting diode pixel driving circuit provided in the embodiment of the present disclosure, the first transistor is capable of storing the reference voltage in the first electrode of the pixel capacitor under the control of the first light emitting signal; and the fourth transistor is capable of connecting the gate electrode of the driving transistor to the drain electrode of the driving transistor under the control of the first scanning signal to read the different between the data voltage and the threshold voltage of the driving transistor and store it in the second electrode of the pixel capacitor. Therefore, during the driving transistor generates the driving current based on the power supply voltage and the voltage at the second electrode of the pixel capacitor, the influences of the power supply voltage and the threshold voltage of the driving transistor are eliminated, such that the generated driving current is irrelevant to the power supply voltage and the threshold voltage of the driving transistor, thereby overcoming the uneven display of the entire image which is caused by the drift of the threshold voltage |Vth| of the driving transistor Tdr and the different driving current driving the different OLEDs to emit light when the different OLEDs receive the same image data signal, the different driving current is caused by the difference of the high-level power supply voltages Vdd actually received between the driving circuit of the various pixel units resulted from the resistance in the high-level power supply transmission lines PL (m).

The embodiment of the present disclosure also provides a display panel including an organic light emitting diode pixel driving circuit provided by the embodiment of the disclosure. Since the first transistor in the organic light emitting diode pixel driving circuit of the display panel is capable of storing the reference voltage in the first electrode of pixel capacitor under the control of the first light emitting signal; and the fourth transistor is capable of connecting the gate electrode of the driving transistor to the drain electrode of the driving transistor under the control of the first scanning signal to read the different between the data voltage and the threshold voltage of the driving transistor and store it in the second electrode of the pixel capacitor. Therefore, during the driving transistor generates the driving current based on the power supply voltage and the voltage at the second electrode of the pixel capacitor, the influences of the power supply voltage and the threshold voltage of the driving transistor are eliminated, such that the generated driving current is irrelevant to the power supply voltage and the threshold voltage of the driving transistor, thereby overcoming the uneven display of the entire image which is caused by the drift of the threshold voltage |Vth| of the driving transistor Tdr and the different driving current driving the different OLEDs to emit light when the different OLEDs receive the same image data signal, the different driving current is caused by the difference of the high-level power supply voltages Vdd actually received between the driving circuit of the various pixel units resulted from the resistance in the high-level power supply transmission lines PL (m).

The embodiment of the present disclosure also provides a display device including an organic light emitting diode pixel driving circuit provided by the embodiment of the disclosure and the display panel provided by the above embodiment. Since the first transistor in the organic light emitting diode pixel driving circuit of the display panel is capable of storing the reference voltage in the first electrode of pixel capacitor under the control of the first light emitting signal; and the fourth transistor is capable of connecting the gate electrode of the driving transistor to the drain electrode of the driving transistor under the control of the first scanning signal to read the different between the data voltage and the threshold voltage of the driving transistor and store it in the second electrode of the pixel capacitor. Therefore, during the driving transistor generates the driving current based on the power supply voltage and the voltage at the second electrode of the pixel capacitor, the influences of the power supply voltage and the threshold voltage of the driving transistor are eliminated, such that the generated driving current is irrelevant to the power supply voltage and the threshold voltage of the driving transistor, thereby overcoming the uneven display of the entire image which is caused by the drift of the threshold voltage |Vth| of the driving transistor Tdr and the different driving current driving the different OLEDs to emit light when the different OLEDs receive the same image data signal, the different driving current is caused by the difference of the high-level power supply voltages Vdd actually received between the driving circuit of the various pixel units resulted from the resistance in the high-level power supply transmission lines PL (m).

It should be noted that those skilled in the art can understand the drawings are merely the schematic diagrams of one preferred embodiment, the modules or the processes in the drawings are not necessary to implement the present disclosure.

It should be understood for those skilled in the art that the modules in the devices of the embodiment may be disposed in the devices of the embodiment according to the description of the embodiment, or may be altered to be disposed in one or more devices different from that of the present embodiment. The modules in the above embodiment may be combined into one, or may be further split into a plurality of submodules.

The organic light emitting diode pixel driving circuit, the display panel and the display device provided by the present disclosure has been described in detail above. The principle and the implementation mode of the present disclosure are described using the specific examples. The description of the above embodiments is merely used for understanding the method and the core concept of the present disclosure. The various alternations and modifications may be made out for common persons skilled in the art without departing from the spirit or the protection scope of the present disclosure. Therefore, the present disclosure is intended to cover the alternations and modifications of the present disclosure falling within the scope of the appended claims and the equivalents thereof.

The invention claimed is:

1. An organic light emitting diode pixel driving circuit, comprising:

a pixel capacitor, comprising a first electrode and a second electrode, which is configured for storing received voltage and coupling a change valve of a voltage at the first electrode to the second electrode;

a driving transistor, for generating a driving current based on a power supply voltage and a voltage at the second electrode of the pixel capacitor;

a first transistor, for providing a reference voltage to the first electrode of the pixel capacitor under the control of a first light emitting signal, wherein the reference voltage is supplied via a reference voltage transmission line, and the first light emitting signal is supplied via a first light emitting signal transmission line;

a second transistor, for transmitting a high-level power supply voltage to the first electrode of the pixel capacitor under the control of a second light emitting signal, wherein the second light emitting signal is supplied via a second light emitting signal transmission line;

a third transistor and a fourth transistor, both for transmitting a difference between a data voltage and a threshold voltage of the driving transistor to the second electrode of the pixel capacitor under the control of a first scanning signal, wherein the first scanning signal is supplied via a first scanning line; and an organic light emitting diode, which emits light under the control of the driving current generated by the driving transistor, wherein in a first stage, the first light emitting signal is a digital signal at logic low level, the first scanning signal and the second light emitting signal are digital signals at logic high level, the first transistor is turned on, and the second transistor, the third transistor and the fourth transistor are turned off;

in a second stage, the first scanning signal and the first light emitting signal are digital signals at logic low level, the second light emitting signal is a digital signal at logic high level, the first transistor, the third transistor and the fourth transistor are turned on, and the second transistor is turned off; and in a third stage, the first scanning signal and the first light emitting signal are digital signals at logic high level, the second light emitting signal is a digital signal at logic low level, the first transistor, the third transistor and the fourth transistor are turned off, and the second transistor is turned on.

2. The organic light emitting diode pixel driving circuit of claim 1, wherein a first electrode of the first transistor receives the reference voltage, a first electrode of the second transistor receives a high-level power supply voltage, the second electrodes of the first and second transistors are connected to the first electrode of the pixel capacitor;

a first electrode of the third transistor receives the data voltage, a second electrode of the third transistor is connected to a first electrode of the driving transistor;

the fourth transistor is configured to connect the second electrode of the driving transistor to a gate electrode of the driving transistor under the control the first scanning signal, read the difference between the data voltage and the threshold voltage of the driving transistor, and transmit the difference to the second electrode of the pixel capacitor;

a first electrode of the driving transistor receives the high-level power supply voltage or the data voltage in a time-sharing way, the gate electrode of the driving transistor is connected to the second electrode of the pixel capacitor;

the organic light emitting diode comprises a cathode receiving a low-level power supply voltage and an anode receiving the driving current.

3. The organic light emitting diode pixel driving circuit of claim 2, further comprising a fifth transistor, for resetting voltage at the gate electrode of the driving transistor under the control of the second scanning signal.

4. The organic light emitting diode pixels driving circuit of claim 3, wherein the first electrode of the fifth transistor is connected to a gate electrode of the fifth transistor and receives the second scanning signal, and the second electrode of the fifth transistor is connected to the gate electrode of the driving transistor.

5. The organic light emitting diode pixel driving circuit of claim 4, wherein each of the first transistor, the second transistor, the third transistor, the fourth transistor, the fifth transistor, the sixth transistor and the seventh transistor is formed by a PMOS transistor.

6. The organic light emitting diode pixel driving circuit according to claim 5, wherein the first scanning signal, the second scanning signal, the first light emitting signal and the second light emitting signal are digital signals at logic low level.

7. The organic light emitting diode pixel driving circuit of claim 3, wherein each of the first transistor, the second transistor, the third transistor, the fourth transistor, the fifth transistor, the sixth transistor and the seventh transistor is formed by a PMOS transistor.

8. The organic light emitting diode pixel driving circuit according to claim 7, wherein the first scanning signal, the second scanning signal, the first light emitting signal and the second light emitting signal are digital signals at logic low level.

9. The organic light emitting diode pixel driving circuit according to claim 3, wherein the second scanning signal is a digital signal at logic low level in the first stage and is a digital signal at logic high level in the second stage and the third stage.

10. The organic light emitting diode pixel driving circuit of claim 2, further comprising a sixth transistor, wherein a first electrode of the sixth transistor receives the high-level power supply voltage, and a second electrode of the sixth transistor is connected to the first electrode of the driving transistor, for transmitting the high-level power supply voltage to a source electrode of the driving transistor under the control of the second light emitting signal.

11. The organic light emitting diode pixel driving circuit of claim 10, wherein each of the first transistor, the second transistor, the third transistor, the fourth transistor, a fifth transistor, the sixth transistor and the seventh transistor is formed by a PMOS transistor.

12. The organic light emitting diode pixel driving circuit according to claim 11, wherein the first scanning signal, the second scanning signal, the first light emitting signal and the second light emitting signal are digital signals at logic low level.

13. The organic light emitting diode pixel driving circuit of claim 2, further comprising a seventh transistor, wherein a first electrode of the seventh transistor is connected to the second electrode of the driving transistor, and a second electrode of the seventh transistor is connected to an anode of the organic light emitting diode, for providing a driving current generated by the driving transistor to the organic light emitting diode under the control of the second light emitting signal.

14. The organic light emitting diode pixel driving circuit of claim 13, wherein each of the first transistor, the second transistor, the third transistor, the fourth transistor, the fifth transistor, the sixth transistor and the seventh transistor is formed by a PMOS transistor.

15. The organic light emitting diode pixel driving circuit according to claim 14, wherein the first scanning signal, the second scanning signal, the first light emitting signal and the second light emitting signal are digital signals logic low level.

16. The organic light emitting diode pixel driving circuit of claim 2, wherein each of the first transistor, the second transistor, the third transistor, the fourth transistor, a fifth transistor, a sixth transistor and the seventh transistor is formed by a PMOS transistor.

17. The organic light emitting diode pixel driving circuit according to claim 7, wherein the first scanning signal, the second scanning signal, the first light emitting signal and the second light emitting signal are digital signals at logic low level.

18. A display panel, comprising:

an organic light emitting diode pixel driving circuit, comprising:

a pixel capacitor, comprising a first electrode and a second electrode, which is configured for storing received voltage and coupling a change value of a voltage at the first electrode to the second electrode;

a driving transistor, for generating a driving current based on a power supply voltage and a voltage at the second electrode of the pixel capacitor;

a first transistor, for providing a reference voltage to the first electrode of the pixel capacitor under the control of a first light emitting signal, wherein the reference voltage is supplied via a reference voltage transmission line, and the first light emitting signal is supplied via a first light emitting signal transmission line;

a second transistor, for transmitting a high-level power supply voltage to the first electrode of the pixel capacitor under the control of a second light emitting signal, wherein the second light emitting signal is supplied via a second light emitting signal transmission line;

a third transistor and a fourth transistor, both for transmitting a difference between a data voltage and a threshold voltage of the driving transistor to the second electrode of the pixel capacitor under the control of a first scanning signal, wherein the first scanning signal is supplied via a first scanning line; and an organic light emitting diode, which emits light under the control of the driving current generated by the driving transistor, wherein in a first stage, the first light emitting signal is a digital signal at logic low level, the first scanning signal and the second light emitting signal are digital signals at logic high level, the first transistor is turned on, and the second transistor, the third transistor and the fourth transistor are turned off;

in a second stage, the first scanning signal and the first light emitting signal are digital signals at logic low level, the second light emitting signal is a digital signal at logic high level, the first transistor, the third transistor and the fourth transistor are turned on, and the second transistor is turned off; and in a third stage, the first scanning signal and the first light emitting signal are digital signals at logic high level, the second light emitting signal is a digital signal at logic low level, the first transistor, the third transistor and the fourth transistor are turned off, and the second transistor is turned on.

19. A display device, comprising:

an organic light emitting diode pixel driving circuit, comprising:

a pixel capacitor, comprising a first electrode and a second electrode, which is configured for storing received voltage and coupling a change value of a voltage at the first electrode to the second electrode;

a driving transistor, for generating a driving current based on a power supply voltage and a voltage at the second electrode of the pixel capacitor;

a first transistor, for providing a reference voltage to the first electrode of the pixel capacitor under the control of a first light emitting signal, wherein the reference voltage is supplied via a reference voltage transmission line, and the first light emitting signal is supplied via a first light emitting signal transmission line;

a second transistor, for transmitting a high-level power supply voltage to the first electrode of the pixel capacitor under the control of a second light emitting signal, wherein the second light emitting signal is supplied via a second light emitting signal transmission line:

a third transistor and a fourth transistor, both for transmitting a difference between a data voltage and a threshold voltage of the driving transistor to the second electrode of the pixel capacitor under the control of a first scanning signal, wherein the first scanning signal is supplied via a first scanning line; and an organic light emitting diode, which emits light under the control of the driving current generated by the driving transistor, wherein in a first stage, the first light emitting signal is a digital signal at logic low level, the first scanning signal and the second light emitting signal are digital signals at logic high level, the first transistor is turned on, and the second transistor, the third transistor and the fourth transistor are turned off;

in a second stage, the first scanning signal and the first light emitting signal are digital signals at logic low level, the second light emitting signal is a digital signal at logic high level, the first transistor, the third transistor and the fourth transistor are turned on, and the second transistor is turned off; and in a third stage, the first scanning signal and the first light emitting signal are digital signals at logic high level, the second light emitting signal is a digital signal at logic low level, the first transistor, the third transistor and the fourth transistor are turned off, and the second transistor is turned on.

* * * * *